US009625216B2

(12) United States Patent
Figus

(10) Patent No.: US 9,625,216 B2
(45) Date of Patent: Apr. 18, 2017

(54) HEAT TRANSFER SYSTEM TWO SEPARATE HEAT LOOPS IN EXCHANGE

(75) Inventor: Christophe Figus, Paris (FR)

(73) Assignee: Airbus Defence and Space SAS, Les Mureaux (FR)

( * ) Notice: Subject to any disclaimer, the term of this patent is extended or adjusted under 35 U.S.C. 154(b) by 633 days.

(21) Appl. No.: 13/877,434

(22) PCT Filed: Oct. 5, 2011

(86) PCT No.: PCT/EP2011/067406

§ 371 (c)(1),
(2), (4) Date: Apr. 2, 2013

(87) PCT Pub. No.: WO2012/045784

PCT Pub. Date: Apr. 12, 2012

(65) Prior Publication Data

US 2013/0186602 A1 Jul. 25, 2013

(30) Foreign Application Priority Data

Oct. 8, 2010 (FR) ..... 10 58185
Dec. 7, 2010 (FR) ..... 10 04755

(51) Int. Cl.
*F28D 15/00* (2006.01)
*F28D 15/04* (2006.01)
*F28D 15/02* (2006.01)

(52) U.S. Cl.
CPC ..... *F28D 15/043* (2013.01); *F28D 15/0266* (2013.01); *F28D 15/046* (2013.01)

(58) Field of Classification Search
CPC .. F28D 15/0275; F28D 15/0266; F28D 15/02; F28D 15/04; F28D 15/043
See application file for complete search history.

(56) References Cited

U.S. PATENT DOCUMENTS 4,182,409 A * 1/1980 Robinson, Jr. ..... F24D 11/003 126/400
6,137,682 A * 10/2000 Ishimine ..... G06F 1/20 165/104.21

(Continued)

FOREIGN PATENT DOCUMENTS

CN WO 2008095404 A1 * 8/2008 ..... F28D 15/043
EP 2 032 440 3/2009

(Continued)

OTHER PUBLICATIONS

Mishkinis et al.: Development of Advanced Control Heat Transfer Loop with Remote Compensation Chamber; D. Mishkinis, A. Kulakov, P. Prado, A. Torres; European Space and Technology Centre (ESTEC) ESA.*

(Continued)

*Primary Examiner* — Len Tran
*Assistant Examiner* — Gordon Jones
(74) *Attorney, Agent, or Firm* — Patterson Thuente Pedersen, P.A.

(57) ABSTRACT

The invention relates to a heat transfer system with one main capillary pumped diphasic fluid loop and a secondary capillary pumped diphasic fluid loop suitable for cooling at least one hot source. The main fluid loop and the secondary fluid loop have one evaporator, a vapor pipe capable of conveying the cooling fluid in the vapor state from the evaporator to a condenser, a condenser and a liquid pipe capable of conveying the cooling fluid in the liquid state from the condenser to the evaporator-so that the cooling fluid of the main fluid loop is in heat exchange with the cooling fluid of the secondary fluid loop.

12 Claims, 3 Drawing Sheets

(56) References Cited

U.S. PATENT DOCUMENTS

| | | | | |
|---|---|---|---|---|
| 6,227,288 | B1 * | 5/2001 | Gluck et al. | 165/104.26 |
| 6,253,836 | B1 * | 7/2001 | Mitchell | 165/86 |
| 6,889,754 | B2 * | 5/2005 | Kroliczek et al. | 165/104.26 |
| 7,268,744 | B1 * | 9/2007 | Short et al. | 343/893 |
| 7,317,616 | B2 * | 1/2008 | Li | F28D 15/0283 165/80.2 |
| 2013/0083482 | A1 * | 4/2013 | Uchida | F28D 15/043 361/696 |
| 2013/0333414 | A1 * | 12/2013 | Inaba | H05K 7/20681 62/513 |

FOREIGN PATENT DOCUMENTS

| | | | | |
|---|---|---|---|---|
| ES | WO 2014102402 | A1 * | 7/2014 | F28D 15/043 |
| FR | 2 813 662 | A1 | 3/2002 | |
| FR | 2 919 923 | A1 | 2/2009 | |
| JP | EP 2940415 | A1 * | 11/2015 | H05K 7/20936 |
| WO | WO 02/02201 | A2 | 1/2002 | |
| WO | WO 2008/001004 | A1 | 1/2008 | |

OTHER PUBLICATIONS

WO 2014102402 A1 machine translation.*
WO 2008095404 A1 machine translation.*
Ku J: "Operating Characteristics of Loop Heat Pipes", SAE Paper 1999-01-2007, XX, XX, vol. 108, Jul. 12, 1999 (Jul. 12, 1999), pp. 503-519, XP001029933, p. 15; figure 18.

* cited by examiner

HEAT TRANSFER SYSTEM TWO SEPARATE HEAT LOOPS IN EXCHANGE

RELATED APPLICATIONS

The present application is a National Phase entry of PCT Application No. PCT/EP2011/067406, filed Oct. 5, 2011, which claims priority from FR Application No. 1058185 filed Oct. 8, 2010, and FR Application No. 1004755, filed Dec. 7, 2010, all of which are hereby incorporated by reference herein in their entirety.

FIELD OF INVENTION

The invention relates to a heat transfer system comprising at least two capillary pumped diphasic fluid loops used for cooling at least one hot source.

BACKGROUND OF THE INVENTION

A capillary pumped diphasic fluid loop, often by misuse of language simply called a "fluid loop", is a system that conveys thermal energy from a hot source to a cold source, by using capillarity as the driving pressure, and the (liquid-vapour) phase change is used as a means of conveying energy.

Such a fluid loop generally comprises an evaporator intended to extract heat from a hot source and a condenser intended to return this heat to a cold source. The evaporator and the condenser are linked by a pipe, called a liquid pipe, in which a cooling fluid circulates for the most part in the liquid state in the cold part of the fluid loop, and a pipe, called a vapour pipe, in which the same cooling fluid circulates for the most part in the gaseous state in its hot portion. The various pipes are in the form of tubing elements, generally made of metal (for example made of stainless steel or aluminium) typically having a diameter of a few millimeters. The evaporator comprises a housing containing a capillary structure providing the pumping of the cooling fluid in the liquid phase by capillarity.

The use of a system constituted by at least two fluid loops for cooling a hot source is known. The evaporators of the two fluid loops are both positioned in heat exchange with the hot source, at a distance from each other which can vary from a few centimeters to typically a meter. Such a system can also comprise more than two fluid loops and in particular two groups of fluid loops. In a variant, such a system is suitable for cooling one or more hot sources arranged in different places.

In a first mode of operation of this system, it is desirable that a single fluid loop, called main fluid loop, functions to remove heat from the hot source, the other fluid loop being idle and only starting in the event of a breakdown of the main fluid loop. This mode of operation is generally called "cold redundancy" of the fluid loops.

However, on starting the two fluid loop system, when the temperature of the hot source increases and delivers its thermal power, sometimes both fluid loops start, as each one receives a portion of this thermal energy.

In a second mode of operation of this system, it is desirable for both fluid loops to operate at the same time in order to remove the heat from the hot source. This mode of operation is generally called "hot redundancy" of the fluid loops.

In many cases, on starting the two fluid loop system, only one of the two fluid loops starts, the other fluid loop remaining permanently idle. This manner of operation limits by half the thermal performance of the heat transfer system.

In order to resolve these control difficulties of the two-loop system, it is known, in particular from document EP 2032440, to reduce or stop the transportation capacity of a fluid loop and therefore its thermal performance by heating the cooling fluid situated in its housing, for example by means of a heater or a passive system using a thermal capacity. In this case, a heating power of the housing of approximately a few percent of the thermal power of the fluid loop is sufficient to stop the fluid loop.

It is also known that cooling the housing of the fluid loop promotes the starting of the latter. This cooling can be obtained according to the state of the art by using a cooling element based on the Peltier effect.

However, these solutions are complex to implement due to the use of heaters and/or coolers, temperature sensors and a control logic. Moreover, these solutions require a certain heating power, typically from a few watts to a few tens of watts for fluid loops of 10 to 1000 W power.

A purpose of the present invention is in particular to overcome these drawbacks.

SUMMARY OF THE INVENTION

To this end, a subject of the invention is a heat transfer system comprising at least one main capillary pumped diphasic fluid loop and a secondary capillary pumped diphasic fluid loop; the main fluid loop and the secondary fluid loop being suitable for cooling at least one hot source, the main fluid loop and the secondary fluid loop each comprising at least:

- an evaporator suitable for evaporating a cooling fluid while recovering heat from said hot source;
- a vapour pipe capable of conveying the cooling fluid in the vapour state from the evaporator to a condenser;
- a condenser suitable for condensing the cooling fluid by conveying heat to a cold source; and
- a liquid pipe capable of conveying the cooling fluid in the liquid state from the condenser to the evaporator;

characterized in that the cooling fluid of the main fluid loop is in heat exchange with the cooling fluid in the liquid state of the secondary fluid loop.

Advantageously, the invention passively promotes either the stopping of a fluid loop placed in cold redundancy, or the simultaneous starting and balancing of the operation of several fluid loops placed in hot redundancy. Thus, the invention proposes advantageously to modify the operation of a fluid loop by disturbances contributed by the other fluid loop.

According to particular embodiments, the heat transfer system comprises one or more of the following features:

- the cooling fluid in the vapour state of the main fluid loop is in heat exchange with the cooling fluid in the liquid state of the secondary fluid loop,
- the cooling fluid contained in the vapour pipe of the main fluid loop is in heat exchange with the cooling fluid contained in the evaporator of the secondary fluid loop,
- the evaporator of the secondary fluid loop comprises a reservoir, the cooling fluid contained in the vapour pipe of the main fluid loop being in heat exchange with the cooling fluid contained in said reservoir of the secondary fluid loop,
- the cooling fluid contained in the vapour pipe of the main fluid loop is in heat exchange with the cooling fluid contained in the liquid pipe of the secondary fluid loop, the cooling fluid contained in the vapour pipe of the main fluid loop is in heat exchange with the cooling fluid contained in the condenser of the secondary fluid loop, the cooling fluid in the liquid state of the main fluid loop is in heat exchange with the cooling fluid in the liquid state of the secondary fluid loop, the evaporator of the secondary fluid loop comprises a reservoir, the cooling fluid contained in the liquid pipe of the main fluid loop being in heat exchange with the cooling fluid contained in the reservoir of the secondary fluid loop, the cooling fluid contained in the liquid pipe of the main fluid loop is in heat exchange with the cooling fluid contained in the liquid pipe of the secondary fluid loop, the cooling fluid contained in the liquid pipe of the main fluid loop is in heat exchange with the cooling fluid contained in the condenser of the secondary fluid loop, said heat exchange is carried out by direct or indirect contact between a part of the main fluid loop and a part of the secondary fluid loop, the main fluid loop and the secondary fluid loop are suitable for cooling the same hot source.

BRIEF DESCRIPTION OF THE DRAWINGS

The invention will be better understood on reading the following description, given non-limitatively by way of example only, and with reference to the drawings in which.

DETAILED DESCRIPTION OF THE DRAWINGS

In the present description the terms "downstream" and "upstream" are determined with respect to the general direction of fluid flow in the loop.

Figure 1:
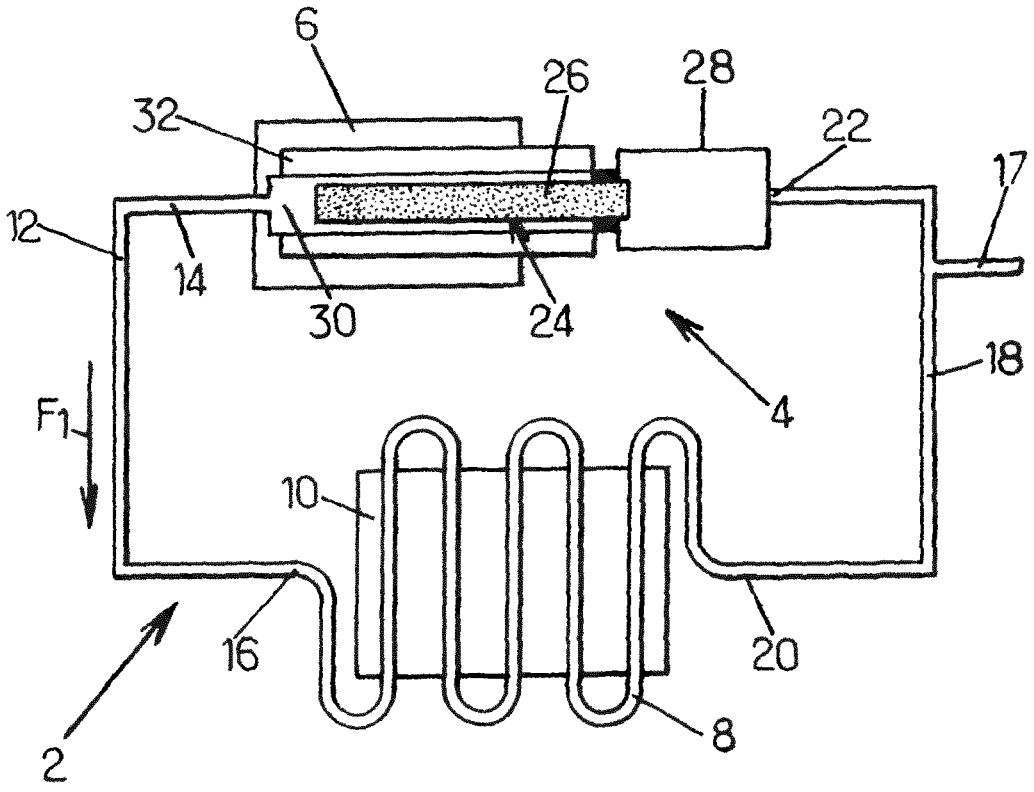
FIG. 1 is a partial diagrammatic top view in cross section of a capillary pumped diphasic fluid loop of a heat transfer system according to the invention.

With reference to FIG. 1, a capillary pumped diphasic fluid loop 2 of a heat transfer system according to the invention comprises an evaporator 4 that extracts heat from a hot source 6 to be cooled and a condenser 8 which returns this heat to a cold source 10. The hot source is for example an item of heat-dissipating electronic equipment placed on board a machine. The cold source is, for example, a radiator arranged on an outer face of the machine.

The fluid loop 2 also comprises a vapour pipe 12 connecting the output 14 of the evaporator 4 to the inlet 16 of the condenser 8 and a liquid pipe 18 connecting the outlet 20 of the condenser 8 to the inlet 22 of the evaporator 4.

The vapour pipe 12 can include one or more by pass branches (not shown in the figure). Similarly, the liquid pipe 18 can comprise one or more by pass branches and/or a filler pipe 17 by means of which the fluid loop is generally filled.

The fluid loop 2 contains a cooling fluid constituted, for example, by ammonia of formula $NH_3$.

The evaporator 4 comprises a housing 24 containing a capillary structure 26 carrying out the pumping of the cooling fluid in the liquid phase by capillarity. This capillary structure 26 is arranged in the housing 24 so as to separate the latter in a first part of the housing 28, hereinafter called the reservoir 28, containing a reserve of cooling fluid in the liquid state, and a second part of the housing 30 containing the cooling fluid in the gaseous state. The reservoir 28 communicates with the liquid pipe 18 by the inlet 22 of the evaporator. The second part of the reservoir 30 communicates with the vapour pipe 12 by the outlet 14 of the evaporator.

The reservoir 28 contains cooling fluid in a liquid state arriving via the liquid pipe 18 of the fluid loop, this cooling fluid advantageously soaking in at least one part of the capillary structure 26. According to the state of the art (see patent FR 2919923) embodiments exist in which the capillary structure is extended into the liquid pipe, making it possible to integrate the functions of the housing with the liquid pipe.

The evaporator 4 is capable of absorbing heat extracted from the hot source 6 by evaporation of the cooling fluid circulating in the fluid loop 2. In particular, the cooling fluid in the liquid state evaporates in the capillary structure 26 under the effect of a thermal flux transmitted to said capillary structure 26 advantageously via an intermediate structure 32 promoting heat exchange. The capillary structure 26 thus allows a capillary pumping of the cooling fluid contained in the housing 28. The cooling fluid in the gaseous state leaving the evaporator 4 is transferred, by the vapour pipe 12, to the condenser 8 (circulation following the arrow F1). The condenser 8 is capable of returning and removing the heat to the cold source 10 by condensation of the cooling fluid. The cooling fluid in liquid phase then returns, downstream of the condenser 8, by the liquid pipe 18, into the evaporator 4 in order thus to form the heat transfer fluid loop 2.

In this application, the "cold part" of the fluid loop 2 will denote the set of elements in which the cooling fluid circulates mainly in the liquid state, i.e. at a temperature that is lower than the temperature of the cooling fluid situated in the vapour pipe 12 when the fluid loop 2 is in operation. In particular, this cold part comprises the condenser 8, the reservoir 28, the liquid pipe 18, as well as any branch of this pipe such as the filler pipe 17.

In this application, "hot part" of the fluid loop 2 denotes the set of tubing elements in which cooling fluid circulates mainly in the gaseous state, at a temperature that is higher than the the temperature of the fluid situated in the cold part when the fluid loop 2 is in operation. In particular, this hot part comprises the vapour pipe 12 as well as any by-pass branch of this pipe.

Figure 2:
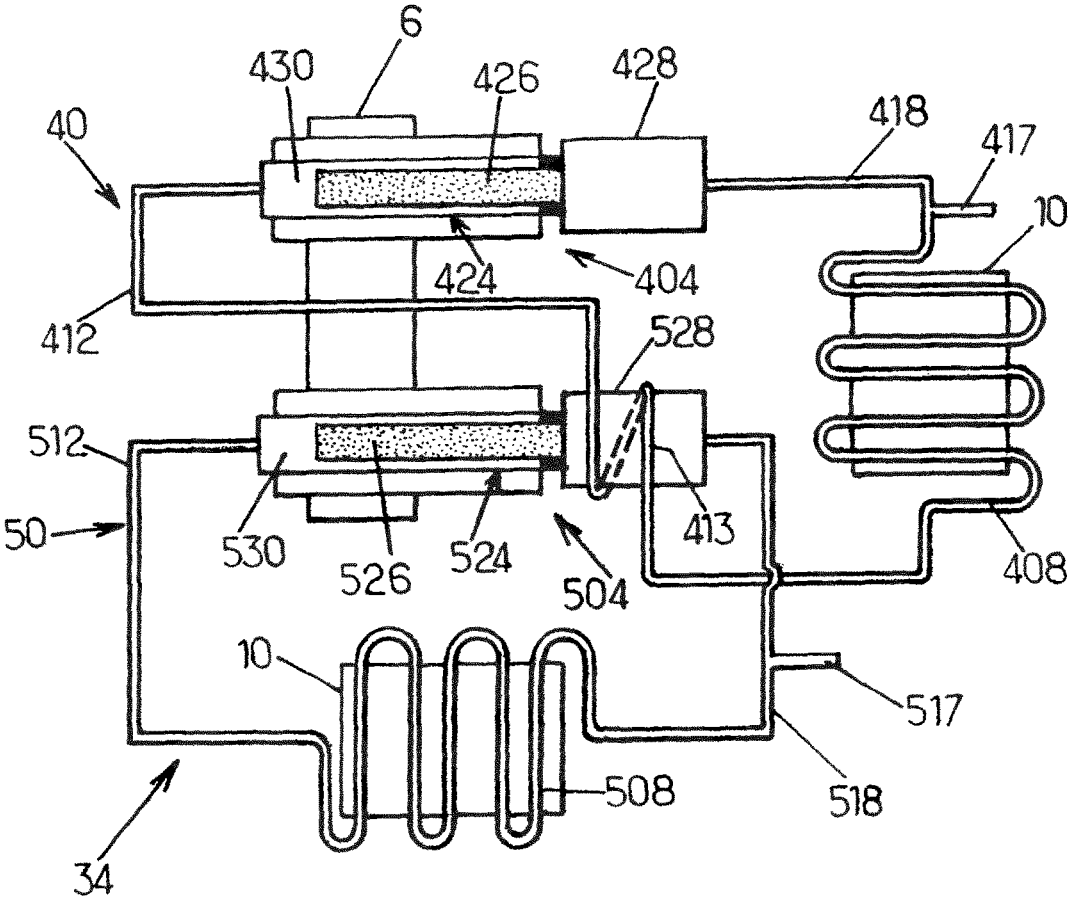
FIG. 2 is a partial diagrammatic top view in cross section of a heat transfer system according to a first embodiment of the invention operating in the mode of operation called "cold redundancy"

With reference to FIG. 2, the heat transfer system 34 according to the first embodiment of the invention comprises a main fluid loop 40 and a secondary fluid loop 50 suitable for cooling the same hot source 6 represented by a rectangle in FIG. 2, by transferring heat to one or more cold sources represented by a rectangle labelled 10 in FIG. 2. This heat transfer system 34 operates, in the embodiment shown in FIG. 2, according to a mode of operation called "cold redundancy".

The main fluid loop 40 and the secondary fluid loop 50 comprise technical elements that are similar to the fluid loop 2 shown in FIG. 1. These technical elements will not be described a second time. They are labelled with the same references as in FIG. 1 preceded by the number 4 when they belong to the main fluid loop 40, and preceded by the number 5 when they belong to the secondary fluid loop 50.

When the heat transfer system 34 operates according to a mode of operation called "cold redundancy", the cooling fluid in the vapour state of the main fluid loop 40 is in heat exchange with the cooling fluid in the liquid state of the secondary fluid loop 50.

For example, in the heat transfer system 34 shown in FIG. 2, the cooling fluid contained in the vapour pipe 412 of the main fluid loop 40 is in heat exchange with the cooling fluid contained in the reservoir 528 of the secondary fluid loop 50 containing cooling fluid in the liquid state.

This heat exchange is advantageously created by direct thermal contact by means of a winding 413 the vapour pipe 412 around the reservoir 528, as shown diagrammatically in FIG. 2.

The advantage of this embodiment is that the heat exchange between the two fluid loops 40 and 60 can be carried out easily, without additional parts, and regardless of the distance between the evaporators 404, 504 of the two fluid loops. This distance is typically capable of reaching a distance of up to one meter.

In a variant, this heat exchange is created by indirect thermal contact, such as for example by attaching a thermally conductive plate linking the vapour pipe 412 to the reservoir 528.

In a variant, the heat exchange can also be carried out indirectly by means of an intermediate device such as a thermal braid or heat pipe linking said vapour pipe 412 to the reservoir 528, or by radiation or any other device known to a person skilled in the art in order to facilitate the heat exchange between two parts.

In a variant, the cooling fluid contained in the vapour pipe 412 of the main fluid loop 40 is in heat exchange with the cooling fluid contained in at least one element of the cold part of the secondary fluid loop 50, such as the liquid pipe 518 including any by-pass branch, the evaporator 504 and the condenser 508. This variant is particularly advantageous in the case of small reservoirs, or when the reservoir function is integrated with the liquid pipe.

In a variant, the heat exchange is carried out between the cooling fluid contained in a by-pass branch of the vapour pipe 412 and an element of the cold part of the secondary fluid loop 50, as previously indicated.

In a variant, the vapour pipe 412 of the main fluid loop 40 is in heat exchange with a portion of the liquid pipe 518 situated close to the reservoir 528. This portion of the liquid pipe extends, for example, to one meter.

As soon as the main fluid loop 40 starts, the circulation of the cooling fluid in vapour phase in the vapour pipe 412 of the main fluid loop 40 heats the reservoir 528 of the secondary fluid loop 50 and thus halts its startup.

In the event of a malfunction of the main fluid loop 40, the heat produced by the hot source 6 will no longer be transported by the latter in vapour form, but in the form of conduction only, via the vapour pipe 412 itself. However, the thermal conductivity of this vapour pipe 412 is very low, typically 20. $10^{-6}$ W/K/m. The temperature of the vapour pipe 412 of the main fluid loop 40 will reduce, which will have the effect of releasing the start of the secondary fluid loop 50, particularly as the latter will receive an increasingly large thermal flux from the hot source 6 due to the fact of stopping the transfer of heat from the main fluid loop 40.

Figure 3:
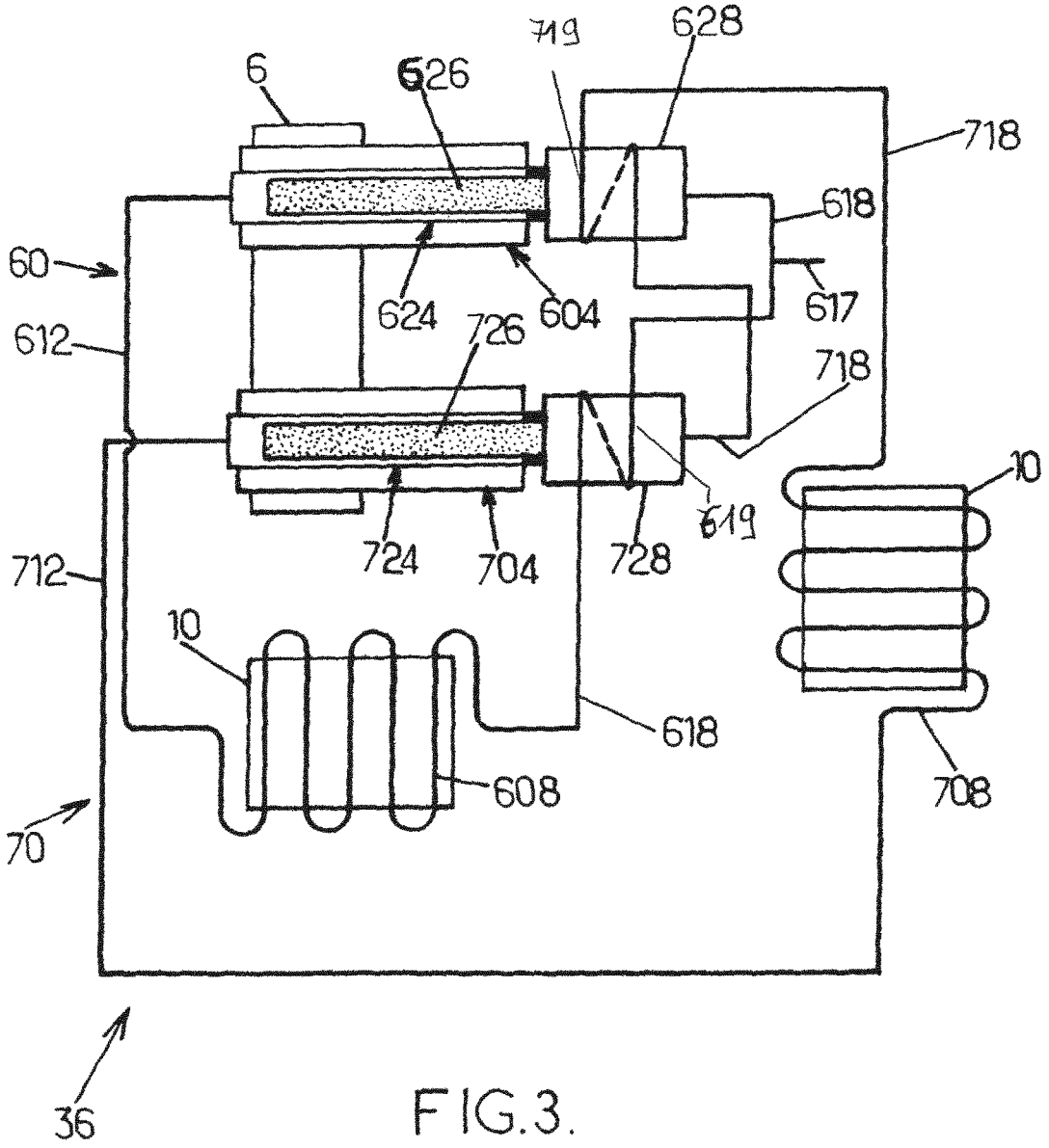
FIG. 3 is a partial diagrammatic top view in cross section of a heat transfer system according to a second embodiment of the invention operating in the mode of operation called "hot redundancy".

With reference to FIG. 3, the heat transfer system 36 according to the second embodiment of the invention comprises a main fluid loop 60 and a secondary fluid loop 70 suitable for cooling the same hot source 6 shown in dotted lines in FIG. 3 by transferring heat to one or more cold sources shown diagrammatically by the rectangle labelled 10 in FIG. 3. This heat transfer system 36 operates, in the embodiment shown in FIG. 3, according to a mode of operation called "hot redundancy".

The main fluid loop 60 and the secondary fluid loop 70 comprise the same technical elements as the fluid loop 2 shown in FIG. 1. They will not be described a second time. These technical elements are labelled with the same references as in FIG. 1 preceded by the number 6 when they belong to the main fluid loop 60, and preceded by the number 7 when they belong to the secondary fluid loop 70.

In this second embodiment operating according to a mode of operation called "hot redundancy", the cooling fluid of the main fluid loop 60 is in heat exchange with the cooling fluid in the liquid state of the secondary fluid loop 70.

For example in FIG. 3, the cooling fluid contained in the liquid pipe 618 of the main fluid loop 60 is in heat exchange, by winding 619, with the cooling fluid contained in the reservoir 728 of the secondary fluid loop 70. Moreover, the cooling fluid contained in the fluid pipe 718 of the secondary fluid loop 70 is in heat exchange, by winding 719, with the cooling fluid contained in the reservoir 628 of the main fluid loop 60.

The heat exchange can be carried out by any other means, direct or indirect, such as those previously mentioned.

In a variant, the cooling fluid contained in at least one element of the cold part of the main fluid loop 60, preferably from the liquid pipe 618 including any derivation branch of this pipe, the reservoir 628 and the condenser 608, is in heat exchange with the cooling fluid contained in at least one element of the cold part of the secondary fluid loop 70, preferably from the liquid pipe 718 including any by-pass of this pipe, the reservoir 728 and the condenser 708.

In a variant, the vapour pipe 612 of the main fluid loop 60 is in heat exchange with a portion of the liquid pipe situated close to the reservoir 728. This portion of the liquid pipe extends, for example, to one meter.

The liquid pipes 618 and 718 bring cooling fluid in liquid phase coming from the condensers 608 and 708 at a temperature markedly lower than the temperature of the fluid loop close to the evaporators 604, 704. The cold point thus created by the pipes of liquid 618, 718 on each of the reservoirs promotes the start and the balanced operation of the two fluid loops, each promoting the other simply by its operation.

In a variant, the thermal transfer system 36 comprises several, and in particular more than two diphasic fluid loops. It is thus possible to imagine an operation of three fluid loops in hot redundancy, in which the liquid pipe of each of the three fluid loops is in heat exchange with at least one element of the cold part of the two other fluid loops, the three fluid loops thus operating in a balanced manner in hot redundancy.

In a variant, such a thermal transfer system 36 is suitable for cooling several hot sources arranged in different places, two fluid loops being capable of cooling two different hot sources.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A heat transfer system comprising at least one main capillary pumped diphasic fluid loop and a secondary capillary pumped diphasic fluid loop; the main fluid loop and the secondary fluid loop cooling at least one hot source, the main fluid loop including at least:

a main evaporator evaporating a main cooling fluid by recovering heat from said hot source; wherein the main evaporator includes a capillary structure;

a main vapour pipe conveying the main cooling fluid in the vapour state from the main evaporator to a main condenser;

the main condenser condensing the main cooling fluid by conveying heat to a first cold source; and a main liquid pipe conveying the main cooling fluid in the liquid state from the main condenser to the main evaporator;

the secondary fluid loop including at least:

a secondary evaporator evaporating a secondary cooling fluid by recovering heat from said hot source; wherein the secondary evaporator includes a secondary capillary structure;

a secondary vapour pipe conveying the secondary cooling fluid in the vapour state from the secondary evaporator to a secondary condenser;

the secondary condenser condensing the secondary cooling fluid by conveying heat to a second cold source; and a secondary liquid pipe conveying the secondary cooling fluid in the liquid state from the secondary condenser to the secondary evaporator;

the main cooling fluid of the main fluid loop is in heat exchange with the secondary cooling fluid in the liquid state of the secondary fluid loop, wherein the main cooling fluid being distinct from the secondary cooling fluid and the main fluid loop being separate from the secondary fluid loop.

2. The heat transfer system according to claim 1, wherein the main cooling fluid in the vapour state of the main fluid loop is in heat exchange with the secondary cooling fluid in the liquid state of the secondary fluid loop.

3. Heat transfer system according to claim 1, wherein the main cooling fluid contained in the main vapour pipe of the main fluid loop is in heat exchange with the secondary cooling fluid contained in the secondary evaporator of the secondary fluid loop.

4. The heat transfer system according to claim 1, wherein the secondary evaporator of the secondary fluid loop comprises a secondary reservoir, and in that the main cooling fluid contained in the main vapour pipe of the main fluid loop is in heat exchange with the secondary cooling fluid contained in said secondary reservoir of the secondary fluid loop.

5. The heat transfer system according to claim 1, wherein the main cooling fluid contained in the main vapour pipe of the main fluid loop is in heat exchange with the secondary cooling fluid contained in the secondary liquid pipe of the secondary fluid loop.

6. The heat transfer system according to claim 1, wherein the main cooling fluid contained in the main vapour pipe of the main fluid loop is in heat exchange with the secondary cooling fluid contained in the secondary condenser of the secondary fluid loop.

7. The heat transfer system according to claim 1, wherein the main cooling fluid in the liquid state of the main fluid loop is in heat exchange with the secondary cooling fluid in the liquid state of the secondary fluid loop.

8. The heat transfer system according to claim 1, wherein the secondary evaporator of the secondary fluid loop comprises a secondary reservoir, and in that the main cooling fluid contained in the liquid pipe of the main fluid loop is in heat exchange with the secondary cooling fluid contained in the secondary reservoir of the secondary fluid loop.

9. The heat transfer system according to claim 1, wherein the main cooling fluid contained in the main liquid pipe of the main fluid loop is in heat exchange with the secondary cooling fluid contained in the secondary liquid pipe of the secondary fluid loop.

10. The heat transfer system according to claim 1, wherein the main cooling fluid contained in the main liquid pipe of the main fluid loop is in heat exchange with the secondary cooling fluid contained in the secondary condenser of the secondary fluid loop.

11. The heat transfer system according to claim 1, wherein said heat exchange is carried out by direct or indirect contact between a part of the main fluid loop and a part of the secondary fluid loop.

12. The heat transfer system according to claim 1, wherein the main fluid loop and the secondary fluid loop cool the same hot source.

* * * * *